US009955760B2

(12) United States Patent
Chen et al.

(10) Patent No.: US 9,955,760 B2
(45) **Date of Patent: *May 1, 2018**

(54) ADAPTIVE PIVOTING AND IMPACT REDUCTION TIP ASSEMBLY FOR WALKING AIDS

(71) Applicant: 3C Automation, Inc., Plano, TX (US)

(72) Inventors: Shyh Min Chen, Plano, TX (US); James Dale Jordan, Grapevine, TX (US); Dale Bourland Jordan, Birmingham, AL (US)

(73) Assignee: 3C AUTOMATION, INC., Plano, TX (US)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/654,251

(22) Filed: Jul. 19, 2017

(65) Prior Publication Data

US 2017/0311688 A1 Nov. 2, 2017

Related U.S. Application Data

(63) Continuation-in-part of application No. 15/368,333, filed on Dec. 2, 2016, now Pat. No. 9,737,121.

(60) Provisional application No. 62/262,727, filed on Dec. 3, 2015.

(51) Int. Cl.
*A45B 9/04* (2006.01)
*A61H 3/02* (2006.01)

(52) U.S. Cl.
CPC ..... *A45B 9/04* (2013.01); *A61H 3/0277* (2013.01); *A61H 3/0288* (2013.01)

(58) Field of Classification Search
CPC ..... A61H 3/0288; A61H 3/02; A61H 3/0277; A61H 2003/0205; A45B 9/04; A45B 1/00; A45B 1/04
USPC ..... 135/65, 66, 77, 82, 84; 248/188.9; 482/75, 79–80
See application file for complete search history.

(56) References Cited

U.S. PATENT DOCUMENTS 679,468 A * 7/1901 Pratt ..... A61H 3/0288 114/79 R
2,397,499 A * 4/1946 McGowan ..... A61H 3/0277 135/66
2,453,742 A * 11/1948 Bowen ..... A61H 3/0288 135/77

(Continued)

FOREIGN PATENT DOCUMENTS

EP 0 057 269 A2 10/1981
GB 2 333 446 A 7/1999

(Continued)

*Primary Examiner* — Winnie Yip
(74) *Attorney, Agent, or Firm* — Kenneth L. Green; Averill & Green

(57) ABSTRACT

An adaptive ambulatory support includes a shock absorbing and pivoting tip assembly attached to the staff of a walking aid, such as a cane, crutch or walker. The shock absorbing and pivoting tip assembly includes a shock absorber sandwiched between a lower portion and an upper portion. The shock absorber may be a bendable spring or elastic material. The tip assembly enables the shaft of the walking aid to dynamically pivot without the loss of adherence of the lower portion to the floor surface and simultaneous provides the adaptive shock absorbing capability in any angle during ambulation.

19 Claims, 14 Drawing Sheets

(56) References Cited

U.S. PATENT DOCUMENTS

| | | | | |
|---|---|---|---|---|
| 2,513,193 | A * | 6/1950 | Miller | A47B 91/04 16/38 |
| 3,949,773 | A | 4/1976 | Marescalco | |
| 4,135,536 | A | 1/1979 | Willis | |
| 5,307,828 | A | 5/1994 | Gardner et al. | |
| 5,727,584 | A | 3/1998 | Stanec | |
| 5,794,638 | A * | 8/1998 | Richey | A61H 3/02 135/65 |
| 5,810,038 | A | 9/1998 | Carpinella | |
| 5,865,204 | A | 2/1999 | Bracy | |
| 6,279,592 | B1 | 8/2001 | Yamamoto | |
| 6,374,841 | B1 | 4/2002 | Yamamoto et al. | |
| 6,883,530 | B2 * | 4/2005 | Kawakami | A45B 9/04 135/82 |
| 6,910,246 | B2 * | 6/2005 | Desmarais | A47B 91/066 16/42 R |
| 7,588,044 | B2 * | 9/2009 | Baker | A61H 3/02 135/82 |
| D635,351 | S | 4/2011 | White | |
| 8,596,288 | B2 * | 12/2013 | Daily | A45B 7/00 135/65 |
| 8,607,809 | B2 * | 12/2013 | Jordan | A45B 3/04 135/66 |
| 8,820,339 | B2 * | 9/2014 | Goodwin | A45B 9/04 135/82 |
| 9,226,556 | B1 * | 1/2016 | Chien | A61H 3/0288 |
| 9,233,047 | B2 * | 1/2016 | Jordan | A61H 3/00 |
| 9,386,830 | B2 * | 7/2016 | Crowhurst | A45B 9/00 |
| 2004/0107983 | A1 | 6/2004 | Liao | |
| 2007/0089770 | A1 * | 4/2007 | Park | A61H 3/0277 135/82 |
| 2009/0242008 | A1 | 10/2009 | Thibodeau et al. | |
| 2010/0229903 | A1 | 9/2010 | Ozuna | |
| 2010/0307549 | A1 | 12/2010 | Goodwin | |
| 2010/0313925 | A1 * | 12/2010 | Jiang | A45B 9/04 135/82 |
| 2011/0073146 | A1 | 3/2011 | Miller | |
| 2012/0160286 | A1 | 6/2012 | Ban | |
| 2013/0263903 | A1 | 10/2013 | Basham | |
| 2014/0041700 | A1 | 2/2014 | Wu | |
| 2014/0290709 | A1 | 10/2014 | Basham | |

FOREIGN PATENT DOCUMENTS

| | | | | |
|---|---|---|---|---|
| GB | 2 375 292 | A | 11/2002 | |
| GB | 2424317 | | 9/2006 | |
| GB | 2494906 | A | 3/2013 | |
| JP | 2015089464 | | 5/2015 | |
| JP | 2015089464 | A * | 5/2015 | A45B 9/04 |

* cited by examiner

ADAPTIVE PIVOTING AND IMPACT REDUCTION TIP ASSEMBLY FOR WALKING AIDS

CROSS-REFERENCE TO RELATED APPLICATIONS

The present application claims the priority of U.S. Provisional Patent Application Ser. No. 62/262,727 filed Dec. 3, 2015, and U.S. patent application Ser. No. 15/368,333 filed Dec. 2, 2016, which applications are incorporated in their entirety herein by reference.

BACKGROUND OF THE INVENTION

The present invention relates to walking aids and in particular to a walking cane having a shock absorbing tip.

Walking aids such as walking sticks, crutches and walkers are well known and have been available in many varieties to accommodate a person's need of support and ambulation. Also there are a variety of modifications and accessories to these aids to ergonomically improve the comfort and safety.

Most walking aids are provided with a rubber tip in an effort to provide stable engagement between the walking aids and the floor or other underlying support surface. In practice, however, it has been found that conventional rubber tips possess limitations which often result in severe injury to the user. For example, with most rubber tips the shaft of the walking aids needs to be held in substantially vertical alignment, so that the contact on the bottom of the tip is able to flatly engage the floor surface. Unfortunately, people frequently hold a walking aids at an outward angle from their bodies in an effort to steady themselves, so that the shaft extends at an angle to the floor rather than straight up and down. This causes the rubber tip to contact the floor at an angle, with only an edge of the tip engaging the floor surface. Consequently, when the person's weight bears on the cane at this angle, the tip tends to slide out, often causing the person to fall. Naturally, this problem is even more acute if the floor surface is slick or damp.

There are also numerous shock absorbing accessories added to the walking aids. However, these shock absorbing devices are intended to merely vertically absorb the impact of the cane or other walking aids on the floor surface or other underlying support surface.

While these walking aids fulfill their respective, particular objectives and requirements. They do not disclose an accessory for a walking aids which provides shockingly absorbing to reduce the impact as well as pivoting where the foot or tip of the accessory is maintained in a planar relationship with the supporting floor surface. In this regard where the foot or tip of the free end of the walking aid can be maintained in a parallel planar relationship with the floor supporting surface, no matter at what angle the walking aid is inclined relative to the supporting surface.

BRIEF SUMMARY OF THE INVENTION

The present invention addresses the above and other needs by providing an adaptive ambulatory support includes a shock absorbing and pivoting (or tilting) tip assembly attached to the staff of a walking aid, such as a cane, crutch or walker. The shock absorbing and pivoting tip assembly includes a shock absorber sandwiched between a lower portion and an upper portion. The shock absorber may be a bendable spring or elastic material. The tip assembly enables the shaft of the walking aids to dynamically pivot without the loss of adherence of the lower portion to the floor surface and simultaneous provides the adaptive shock absorbing capability in any angle during ambulation.

In accordance with one aspect of the invention, there is provided an accessory for walking aids which provides shocking absorbing and reduced impact as well as pivoting where the foot or tip of the accessory is maintained in a planar relationship with the supporting ground surface. In this regard where the foot or tip of the free end of the walking aid can be maintained in a parallel planar relationship with the ground supporting surface, no matter at what angle the walking aid is inclined relative to the supporting surface.

BRIEF DESCRIPTION OF THE SEVERAL VIEWS OF THE DRAWING

The above and other aspects, features and advantages of the present invention will be more apparent from the following more particular description thereof, presented in conjunction with the following drawings wherein.

Corresponding reference characters indicate corresponding components throughout the several views of the drawings.

DETAILED DESCRIPTION OF THE INVENTION

The following description is of the best mode presently contemplated for carrying out the invention. This description is not to be taken in a limiting sense, but is made merely for the purpose of describing one or more preferred embodiments of the invention. The scope of the invention should be determined with reference to the claims.

Where the terms "about" or "generally" are associated with an element of the invention, it is intended to describe a feature's appearance to the human eye or human perception, and not a precise measurement.

Figure 1B:
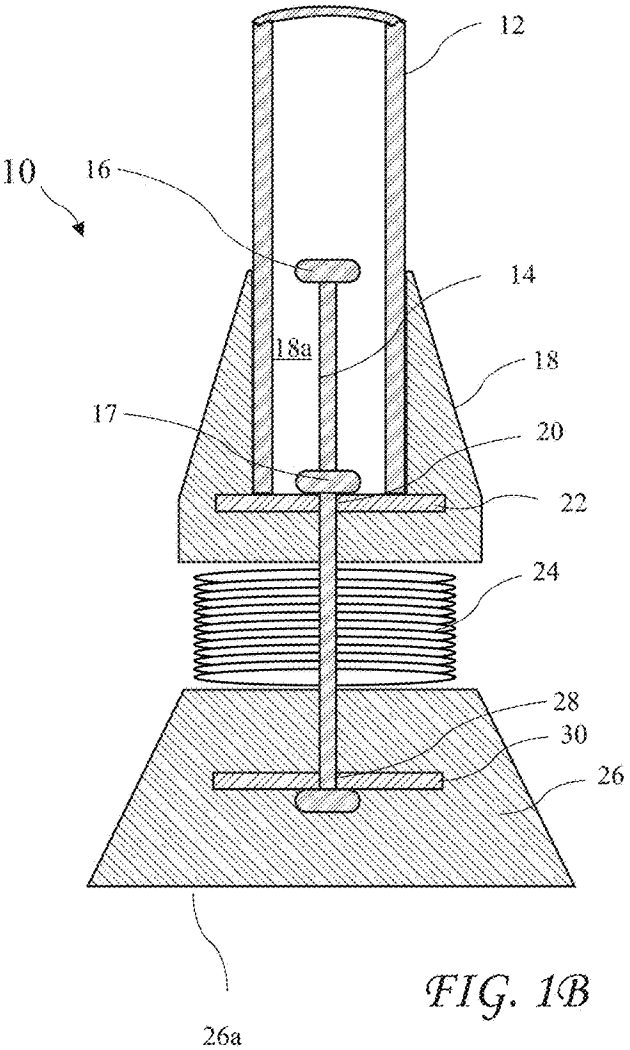
FIG. 1B is a cross-sectional view of the cushioned walking stick tip according to the present invention taken along line 1B-1B of FIG. 1A.
Figure 1A:
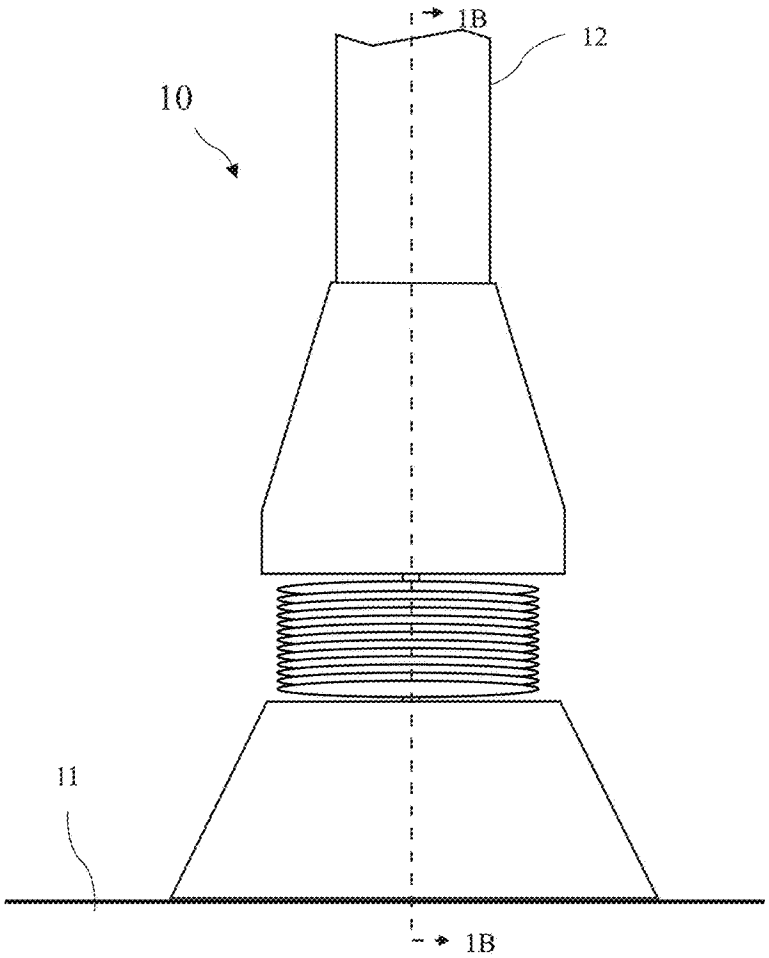
FIG. 1A is a side view of a cushioned walking stick tip according to the present invention.

A side view of a cushioned walking stick tip 10 according to the present invention is shown residing on a generally horizontal surface 11 in FIG. 1A and a cross-sectional view of the cushioned walking stick tip 10 along line 1B-1B of FIG. 1A is shown in FIG. 1B. The cushioned walking stick tip 10 is an economical direct replacement for the simple rubber tip commonly used in walking aids, providing an easy and economical solution to ambulatory support and traction for a walking aid such as a cane, crutches and walkers. The cushioned walking stick tip 10 includes four major components, an upper portion 18 including a shaft passage 18*a* receiving a shaft 12 of the walking aid, a lower portion 26 having a bottom surface 26*a* which maintains a parallel planar relationship with the ground, a shock absorbing element 24 between the upper portion 18 and the lower portion 26, and a pivoting connecting rod 14 embedded in the lower portion 26 and connecting the upper portion 18 to the lower portion 26. The upper portion 18 is preferably connectable to the shaft 12 without tools or an adaptor.

The tip assembly 10 provides an upper pivot 20 in the upper portion 18 and a lower pivot 28 in the lower portion 26. The attitude of the lower pivot 28 is generally fixed with respect to the generally horizontal surface 11 and is limited to movement resulting from deformation of the lower portion 28. The lower pivot 28 allows the angulation of the connecting rod 14 when a rod top stop 16 reaches the inner wall of the shaft 12. The force from the partial body weight and the angulation is passed from the shaft 12 to the rod top stop 16. The force applied to the rod top stop 16 causes the connecting rod 14 to pivot around the lower pivot 28.

The upper portion 18 and upper pivot 20 may both pivot and depress vertically under a load. The position of the upper pivot 20 is the location where the partial body weight bears on the shaft 12 and the compression force of the shock absorber 24 reach a balance. The partial body weight on the shaft 12 is different for each ambulation because of angulation, therefore the tip assembly 10 adaptively seeks the dynamically moving pivot until the balance of the forces is reached. The upper pivot 20 allows the angulation of the shaft 12 relative to both the upper portion 18 and the lower portion 26.

The location of the upper pivot 20 is established by an upper centering piece 22 fixed to the upper portion 18 and the lower pivot 28 may be established by a lower centering piece 30 fixed to the lower portion 26. The upper and lower centering pieces 22 and 30 are preferably disks embedded in the upper portion 18 and lower portion 26 respectively. The connecting rod 14 includes a rod top stop 16 at the top of the connecting rod 14 limiting pivoting about the upper pivot 20 by the connecting rod 14 by contact of the rod top stop 16 with the interior of the shaft 12, and a rod center stop 17 retaining the upper portion 18 on the connecting rod 14.

An upper pivot point 20 allows pivotal motion of the upper portion 18 of the walking aid 10 relative to the connecting rod 14 and the lower portion 26 while the rod top stop 16 is not touching the inner wall of the shaft 12. The connecting rod 14 is generally perpendicular to the lower portion 26 and the surface 11 when relaxed. The lower pivot 28 also allows the angulation of the upper portion 18 and the shaft 12 relative to the lower portion 26 and the surface 11 when the rod top stop 16 touches the inner wall of the shaft 12. Sufficient force on rod top stop 16 due the angulation of the shaft 12 may cause the connecting rod to 14 pivot at the lower pivot point 28.

Figure 2:
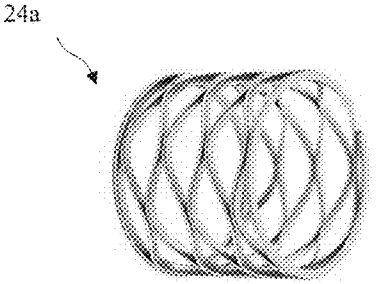
FIG. 2 shows a shock absorber according to the present invention.

The shock absorbing element 24 resides between the upper portion 18 and the lower portion 26 and is retained in place by the connecting rod 14. The shock absorbing element 24 may be a metal spring, elastic material, or any structure which is both compressible and flexible. An example of a suitable shock absorber 24 is a wave spring 24*a* shown in FIG. 2. The spring 24*a* is interchangeable to allow the user to select a different spring 24*a* with different spring constant to provide a desired stability or comfort level.

Figure 3A:
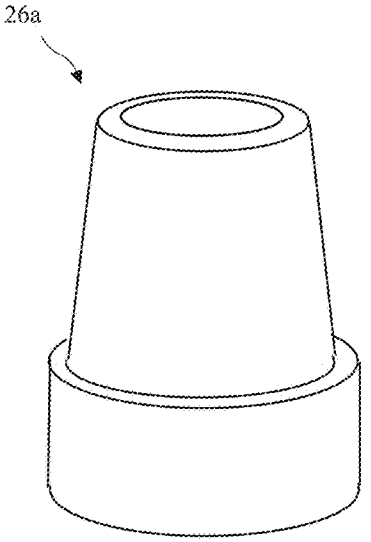
FIG. 3A shows a single contact tip according to the present invention.
Figure 3B:
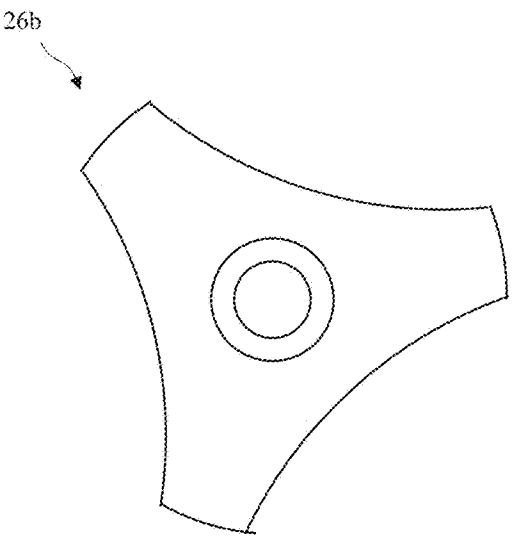
FIG. 3B shows a triple contact tip according to the present invention.
Figure 3C:
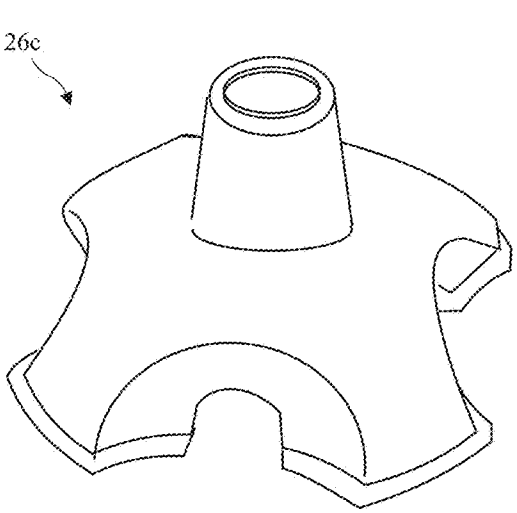
FIG. 3C shows a quadruple contact tip according to the present invention.

The lower portion 26 preferably maintains in a parallel planar relationship with the surface 11. FIGS. 3A, 3B and 3C show examples of single contact 26*a* or multiple contact such three toe tri-pod 26*b* or four toe quad-pod contact 26*c*. The multiple prong lower tips 26*b* and 26*c* enable the support to be self-standing.

The connecting rod 14 is ridged and resides substantially perpendicular to the lower portion 26 and surface 11 for small angular deflections of the shaft 12, and supports dynamic pivoting of the upper portion 18 about the lower pivot 28. The connecting rod 14 is also a mechanical guide which guides the upper portion 18 to move up and down along the connecting rod 14 during ambulation. The connecting rod 14 is a safety device to prevent the upper portion 18 and shaft 12 from over tilting, causing contact of the rod top stop 16 with the shaft 12, which may cause a user to fall.

Figure 4A:
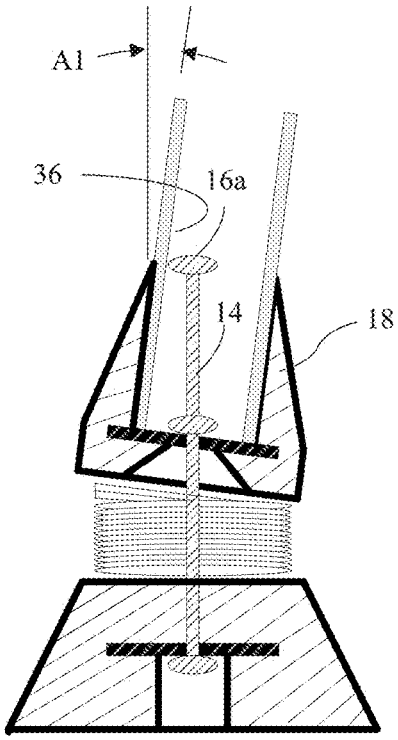
FIGS. 4A and 4B compare angulation of the tip using larger and smaller rod top stops according to the present invention.

FIG. 4A shows the connecting rod 14 with a larger rod top stop 16*a*. The larger rod top stop 16*a* functions as mechanical stop that resists the upper portion 18 and shaft 12 from further tilting thus limits the angle of angulation during ambulation to a first angle A1.

Figure 4B:
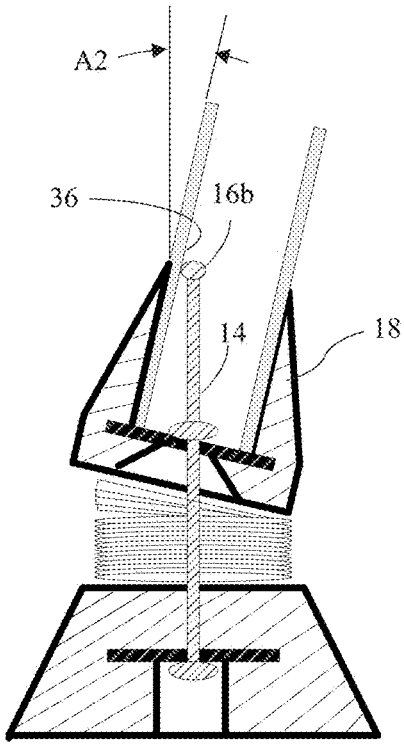

FIG. 4B shows the connecting rod 14 with a smaller rod top stop 16*b*. The rod top stop 16*b* creates clearance to allow the upper portion 16 and the shaft 12 to tilt further to an angle A2 compared to the rod with the larger end stop 16*a*. The end stops 16*a* and 16*b* are preferably interchangeable to allow the user to use different sizes of end stop which fits them better to provide better stability and comfort.

Figure 5A:
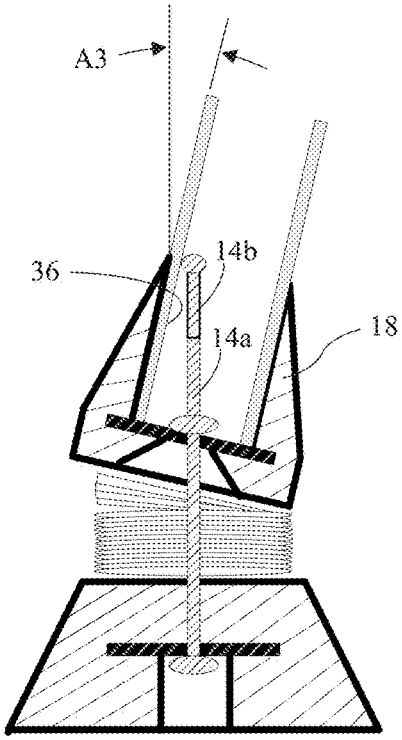
FIGS. 5A and 5B compare angulation of the tip using longer and short connecting rods according to the present invention.
Figure 5B:
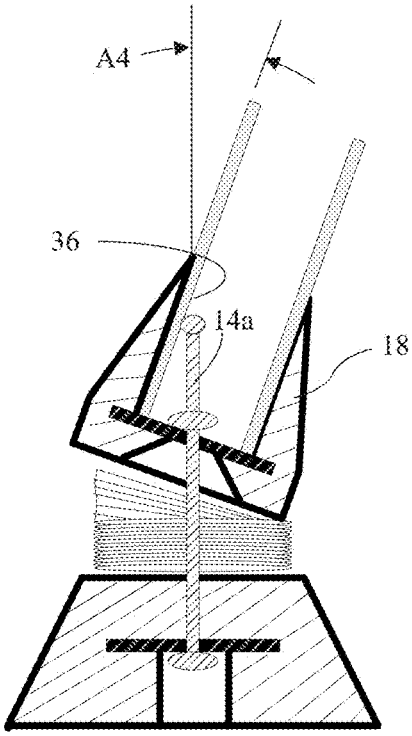

FIGS. 5A and 5B show a connecting rod 14 having an adjustable length. The length of the connecting rod 14 inside the shaft 12 can be extended by attaching a removable rod section 14*b* to a base rod 14*a*. The length can be reduced by detaching the removable rod 14*b*. By adjusting the length of the connecting rod 14 the maximum of angle of upper portion 18 with respect to the connecting rod 14 can be adjusted. A smaller angle A3 is shown in FIG. 5A when the removable rod section 14*b* is attached to the base rod 14*a*, and a greater angle A4 is shown in FIG. 5B when the removable rod section 14*b* is not attached to the base rod 14*a*

Figure 6A:
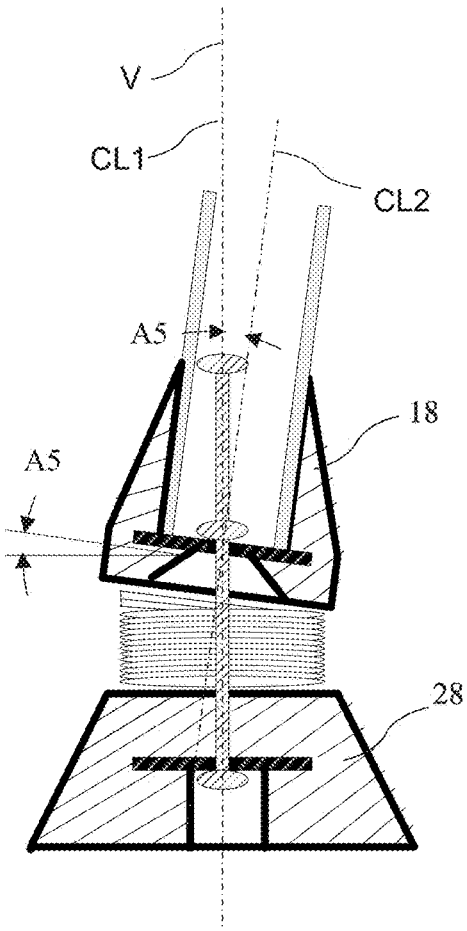
FIGS. 6A and 6B compare angulation of the upper portion of the tip when the connecting rod is vertical and when the connecting rod is tilted, according to the present invention.

FIG. 6A shows a tilt angle A5 between a centerline CL1 of the connecting rod 14 (aligned with vertical V) and a centerline CL2 of the upper portion 18 when the rod top stop 16 reaches the inner wall of shaft 12 during the ambulation of the user. The connecting rod 14 maintains a substantially vertical position and the lower portion 26 maintains a planar relationship to the surface 11 to maintain the stability and safety.

Figure 6B:
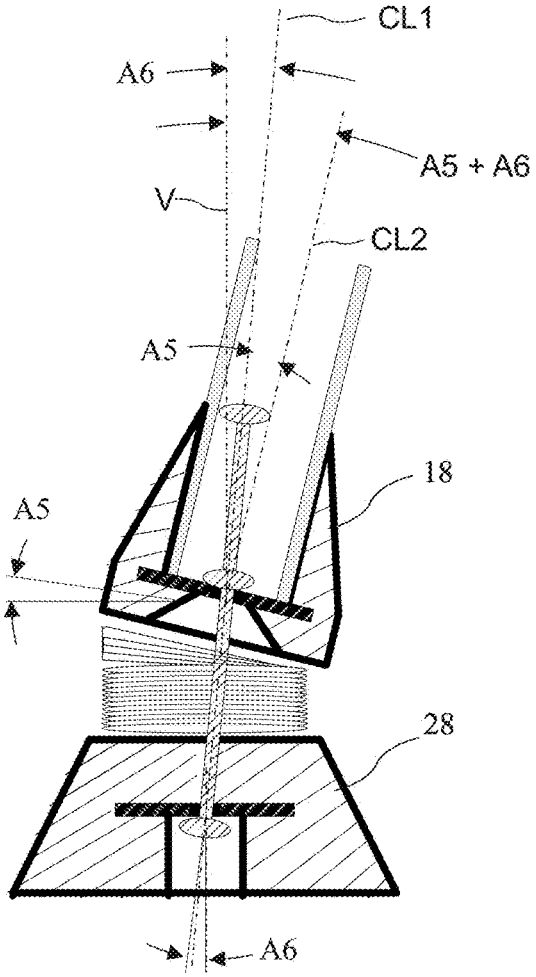

FIG. 6B shows the tilting A5 of the centerline CL2 of upper portion 18 with respect to the connecting rod 14, as well as the tilting A6 of the centerline CL1 of the connecting rod 14 with respect to the vertical V, when force from the inner wall of the shaft 12 is applied against the rod top stop 14. The connecting rod 14 moves away from the vertical V position but the lower portion 28 maintains a planar relationship to the surface 11 to maintain the stability and safety. The tilting angle of the centerline CL1 of the connecting rod 14 with respect to the vertical V is an angle A6. The total angle of angulation of the upper portion 18 is angle A5 plus A6. The total angle of angulation of the upper portion 18 is angle A5 plus A6.

Figure 7C:
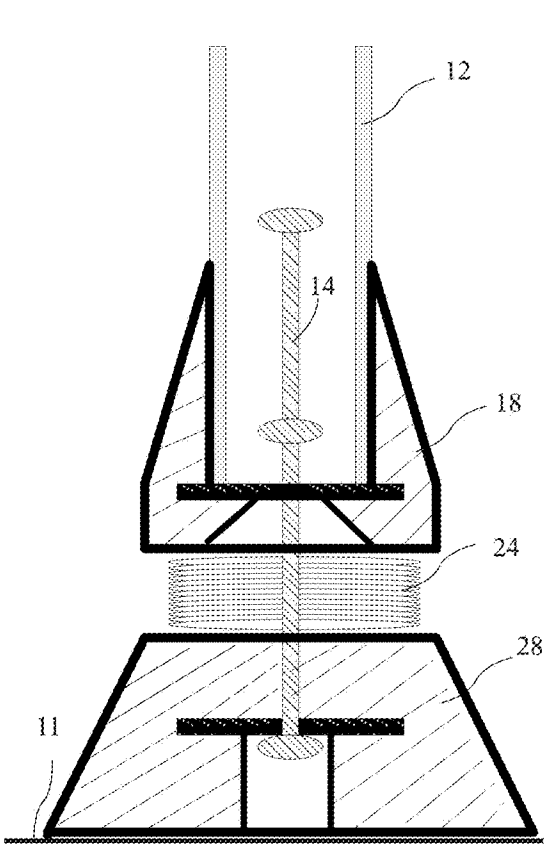
FIGS. 7A, 7B and 7C compare a vertical position of the upper portion for different amounts for vertical force on the tip, according to the present invention.
Figure 7B:
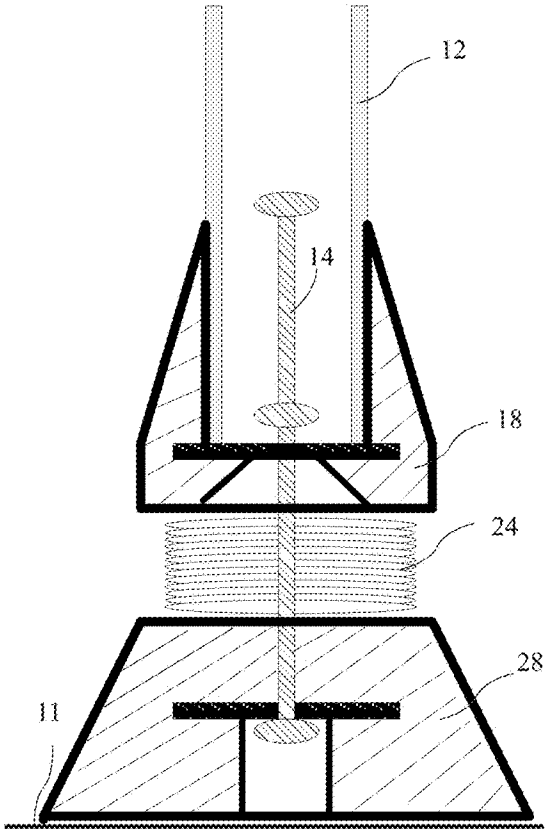
Figure 7A:
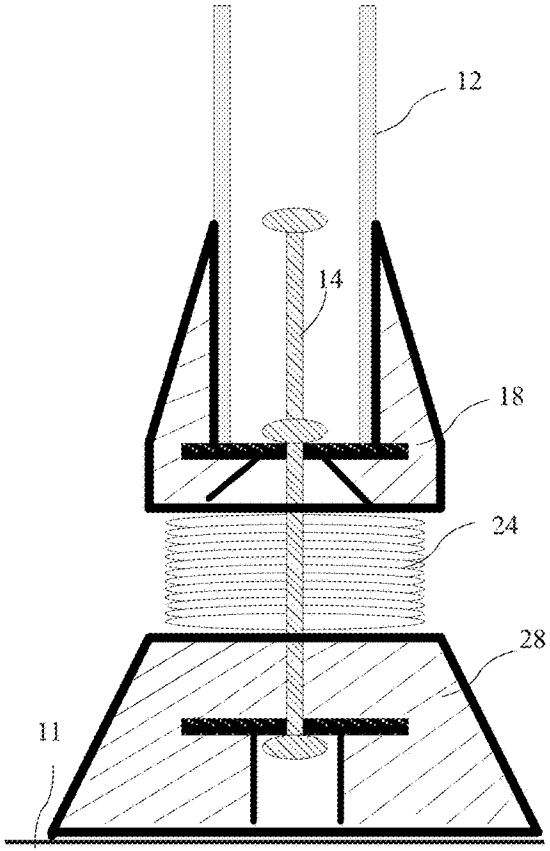

FIGS. 7A, 7B and 7C depict a shock absorbing capability when only a vertical force is applied downward on the cushioned walking stick tip 10. The upper portion 18 moves downward along the connecting rod 14. The distance the upper portion 18 travels downward depends on the downward force and the resistance of the shock absorber 24. The lower portion 28 maintains planar relationship with the surface 11.

Figure 8C:
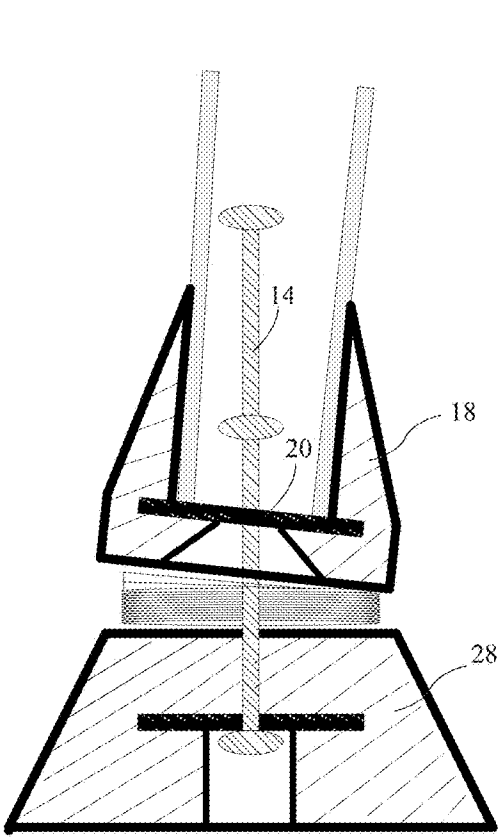
FIGS. 8A, 8B and 8C compare a vertical position of the upper portion for different amounts for vertical force on the tip when the upper portion is tilted, according to the present invention.
Figure 8B:
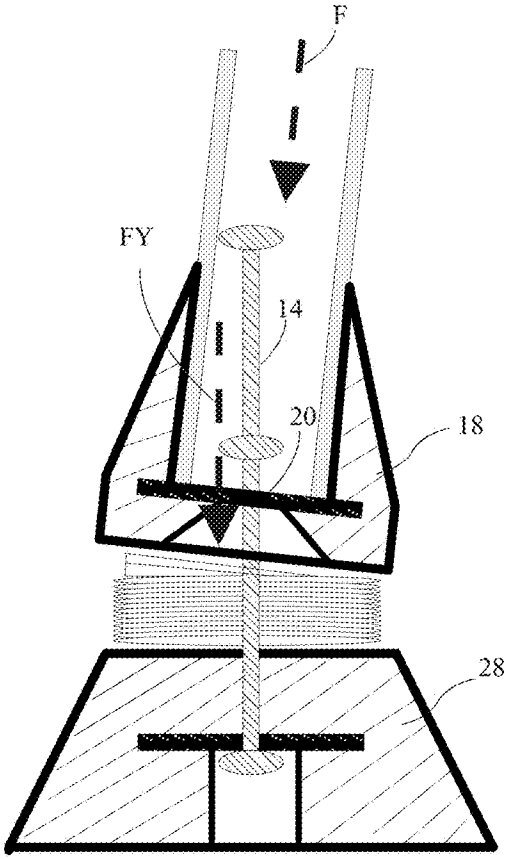
Figure 8A:
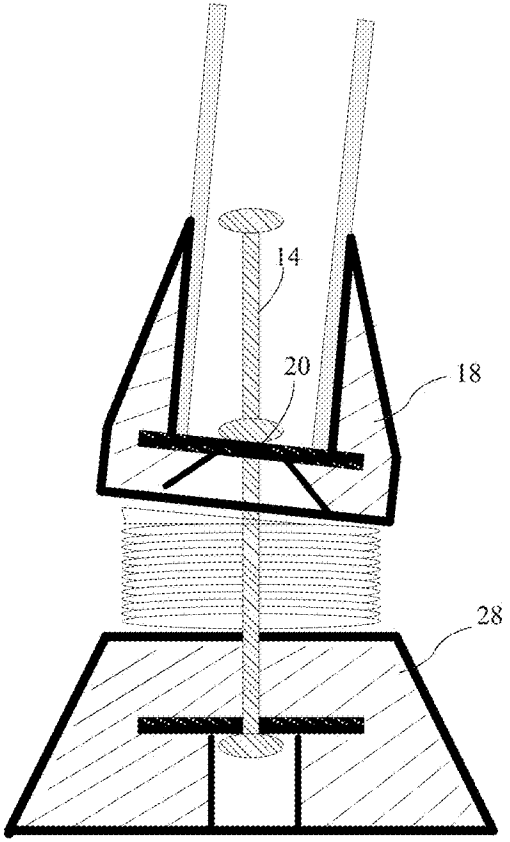

FIGS. 8A, 8B and 8C depict the upper pivot 20 moving progressively along the connecting rod 14 during the ambulation. The upper portion 18 is tilted at a fixed angulation in FIGS. 8A, 8B and 8C for illustration purpose. The actual tilting angle varies depending on the load from partial body weight on the walking aid. The distance the upper portion 18 travels downward depends on the vertical component FY of the force F the shaft 12 exerts on the upper portion 18, and the resistance of the shock absorber 24. The lower portion 28 maintains planar relationship with the surface 11.

Figure 9:
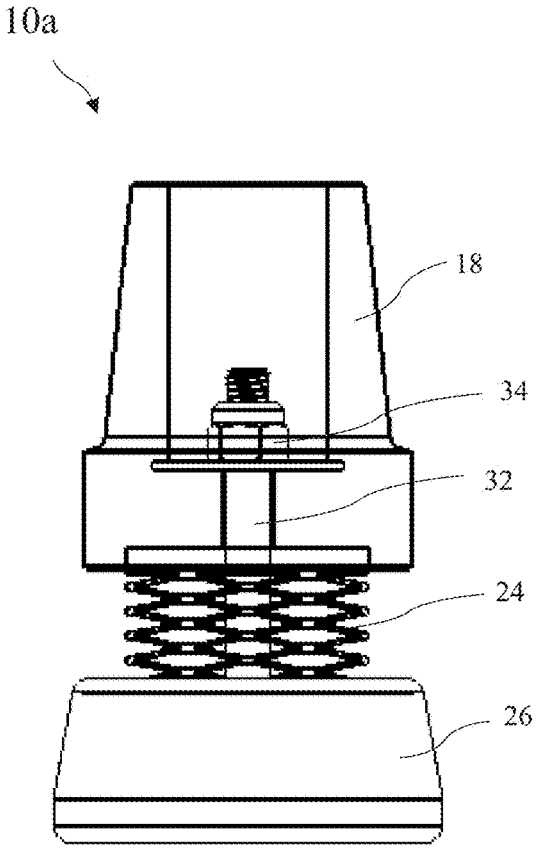
FIG. 9 shows a cushioned walking stick tip according to the present invention including a connecting bolt.
Figure 10:
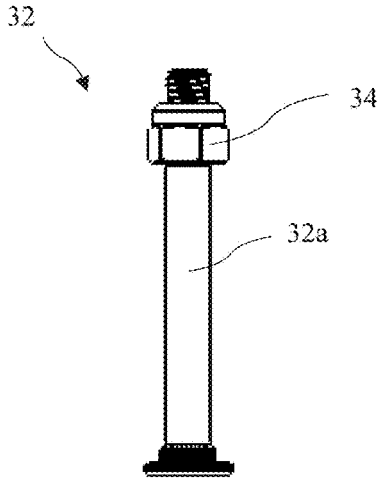
FIG. 10 shows the connecting bolt according to the present invention.

FIG. 9 shows a cushioned walking stick tip 10*a* including a connecting bolt 32 and FIG. 10 shows the connecting bolt 32 and nut 34. The connecting bolt 32 connects the upper portion 18 to the lower portion 26 sandwiching the shock absorber 24. The nut 34 may be a lock nut, or may be a nut tightened against an unthreaded portion 32*a* of the connecting bolt 32.

Figure 11:
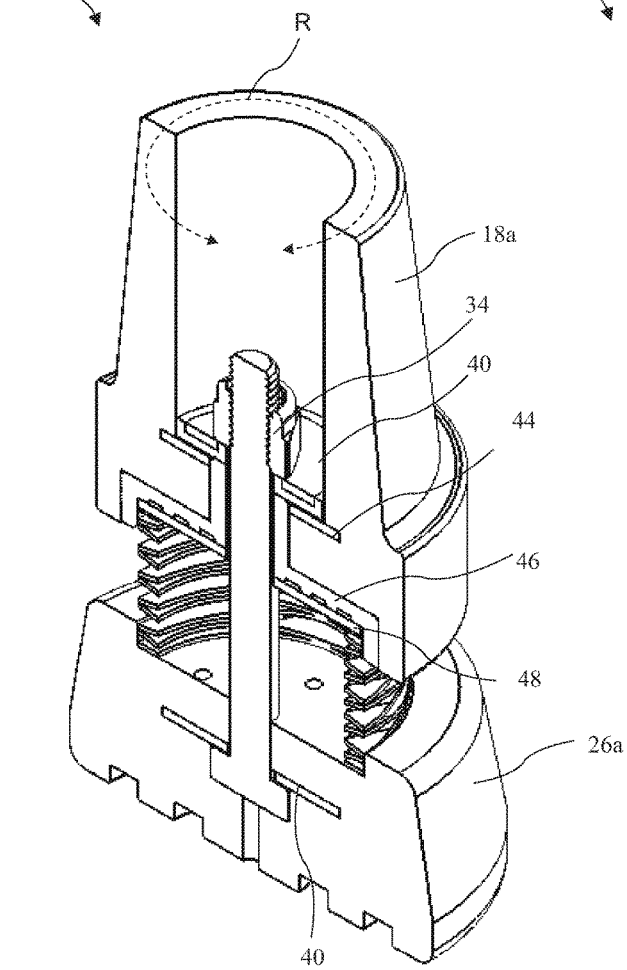
FIG. 11 shows a cushioned walking stick tip according to the present invention providing upper portion rotation.
Figure 12:
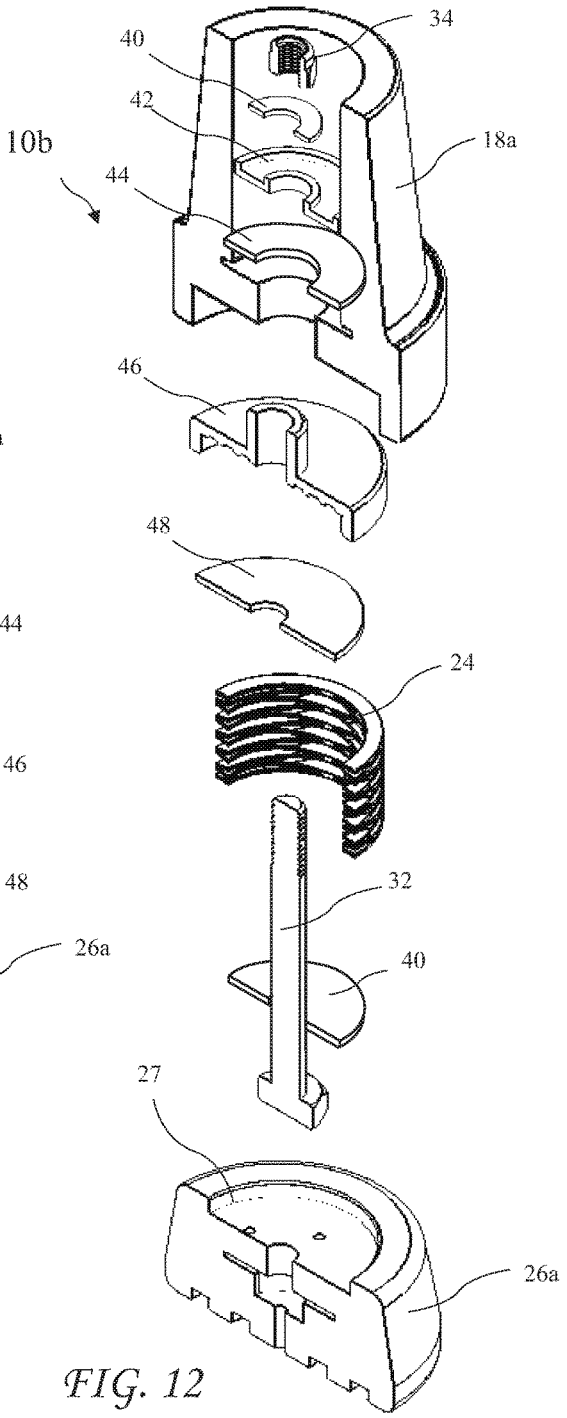
FIG. 12 shows an exploded view of the cushioned walking stick tip according to the present invention providing upper portion rotation.
Figure 13:
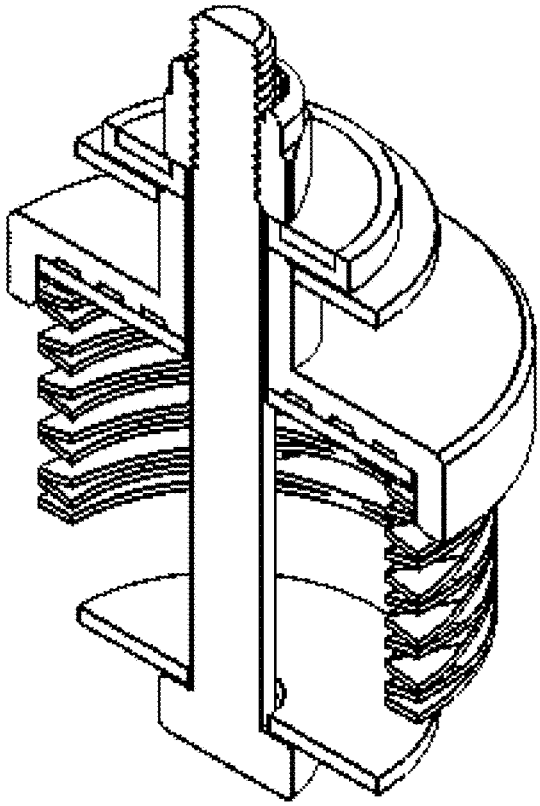
FIG. 13 shows a view of the cushioned walking stick tip according to the present invention providing upper portion rotation with upper and lower portions hidden to show other elements.
Figure 14:
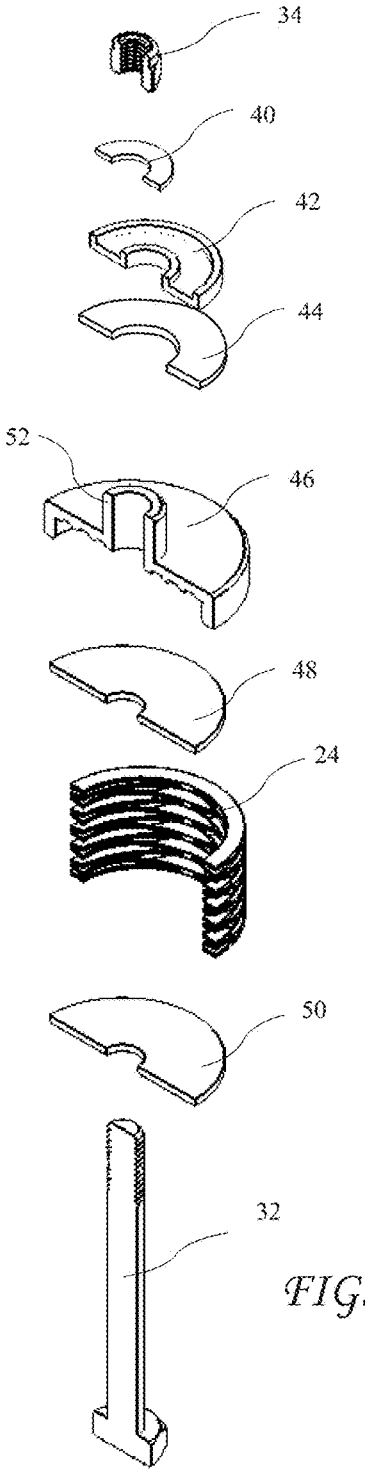
FIG. 14 shows an exploded view of the cushioned walking stick tip according to the present invention providing upper portion rotation with upper and lower portions hidden to show other elements.

A cushioned walking stick tip 10*b* providing upper portion 18*a* rotation R is shown in FIG. 11, an exploded view of the cushioned walking stick tip 10*b* is shown in FIG. 12, a view of the cushioned walking stick tip 10*b* with upper portion 18*a* and lower portion 26*a* hidden to show other elements is shown in FIG. 13, and an exploded view of the cushioned walking stick tip 10*b* providing upper portion rotation with upper portion 18*a* and lower portion 26*a* hidden to show other elements is shown in FIG. 14. The cushioned walking stick tip 10*b* includes a bolt 32 molded into the lower portion to resist tilting of the bolt and connecting the upper portion 18*a* to the lower portion 26*a*. A nut 34 retains the upper portion 18*a* on the bolt 32. A first washer 40 resides under the nut 34 in a recess in a first cup 42. A second washer 44 embedded in the upper portion 18*a* resides under the first cup 42. A second cup 46 (or upper pivot) is embedded in the upper portion 18*a* and includes a cylindrical portion 52 (see FIG. 16) reaching through a passage 56 (see FIG. 17) of the upper portion 18*a*. A third washer 48 resides between the second cup 46 and the shock absorber 24. The second cup 46 and washer 48 are made from self lubricating plastic to facilitate rotation of the top portion 18*a* with respect to the bottom portion 26*a*. The bottom portion 26*a* includes a recess 27 to receive and position the bottom of the shock absorber 24.

Figure 15A:
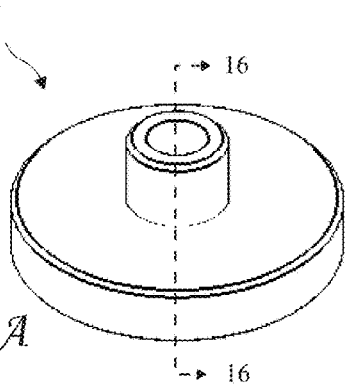
FIG. 15A shows a top view of a cup of the cushioned walking stick tip according to the present invention providing upper portion rotation.
Figure 16:
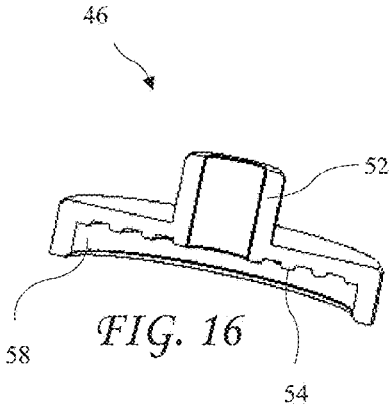
FIG. 16 shows a cross-sectional view of the cup of the cushioned walking stick tip according to the present invention providing upper portion rotation taken along line 16-16 of FIG. 15A.
Figure 15B:
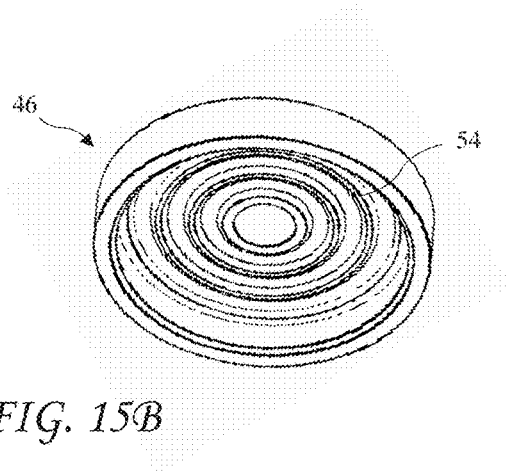
FIG. 15B shows a bottom view of the cup of the cushioned walking stick tip according to the present invention providing upper portion rotation.
Figure 17:
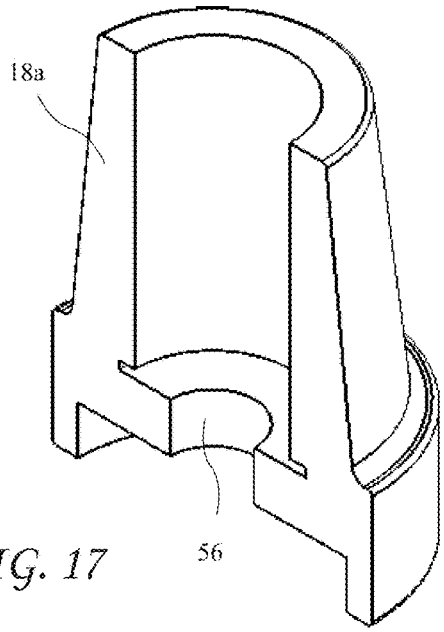
FIG. 17 shows a cross-sectional view of the upper portion according to the present invention.

A top view of the second cup 46 is shown in FIG. 15A, a bottom view of the cup 46 is shown in FIG. 15B, and a cross-sectional view of the cup 46 taken along line 16-16 of FIG. 15A is shown in FIG. 16. The cylindrical portion 52 of the cup 46 passes through the bottom of the upper portion 18*a* and the washer 44, and rests against the bottom of the cup 46, thus preventing deformation of the bottom of the upper portion 18*a*. The cup 46 and the washer 48 are made from self-lubricating material, preferably self lubricating plastic, to allow the upper portion 18*a* to rotate with respect to the lower portion, A cross-sectional view of the upper portion 18*a* is shown in FIG. 17. The portion 18*a* includes a passage 56 provided for the cylindrical portion 52 of the second cup 46, and a bottom recess 58 to receive and position the top of the shock absorber 24.

Figure 18:
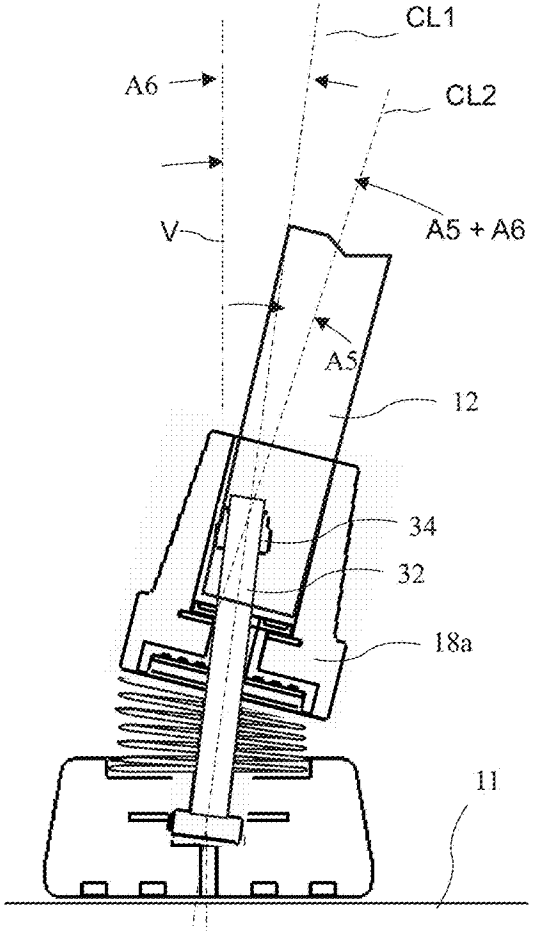
FIG. 18 shows a cross-sectional view of the upper portion according to the present invention where the bolt is tilted with respect to the lower porting and the upper portion is tilted with respect to the bolt.

FIG. 18 shows the tilting A5 of the centerline CL2 of upper portion 18*a* with respect to the bolt 32, as well as the tilting A6 of the centerline CL1 of the bolt 32 deforming the lower portion 26*a*, with respect to the vertical V, when force from the inner wall of the shaft 12 is applied against the nut 34. The bolt 32 moves away from the vertical V position but the lower portion 28 maintains a planar relationship to the surface 11 to maintain the stability and safety. The tilting angle of the centerline CL1 of the bolt 32 with respect to the vertical V is an angle A6. The total angle of angulation of the upper portion 18 is angle A5 plus A6. The total angle of angulation of the upper portion 18 is angle A5 plus A6.

Figure 20B:
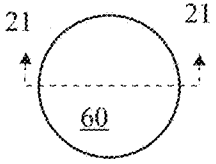
FIG. 20B shows a top view of the spacer according to the present invention for supporting the solid walking stick.
Figure 20A:
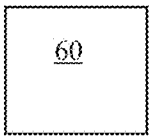
FIG. 20A shows a side view of a spacer according to the present invention for supporting the solid walking stick.
Figure 20C:
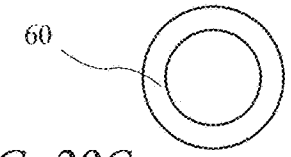
FIG. 20C shows a bottom view of the spacer according to the present invention for supporting the solid walking stick.
Figure 21:
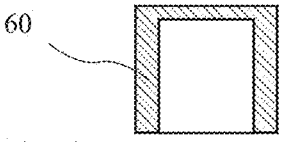
FIG. 21 shows a cross-sectional view of the spacer according to the present invention for supporting the solid walking stick, taken along line 21-21 of FIG. 20B.
Figure 19:
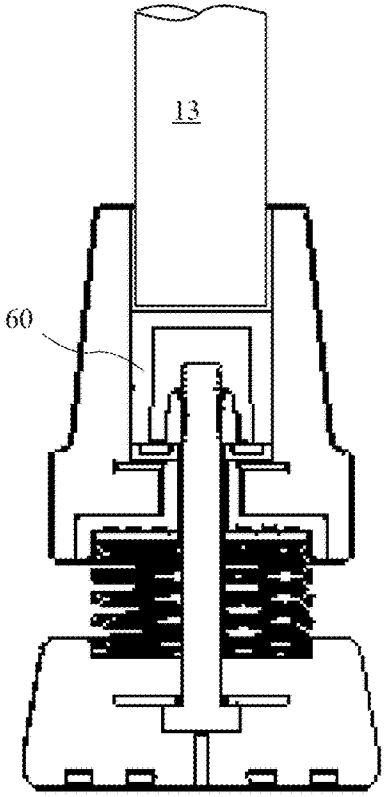
FIG. 19 shows a cross-sectional view of the upper portion according to the present invention where a solid walking stick has replaced a hollow shaft.

A cross-sectional view of the upper portion where a solid walking stick 13 has replaced the hollow shaft 23, and a s spacer 60 supports the solid walking stick 13. A side view of the spacer 60 is shown in FIG. 20A, a top view of the spacer 60 is shown in FIG. 20B, a bottom view of the spacer 60 is shown in FIG. 20C, and a cross-sectional view of the spacer 60 taken along line 21-21 of FIG. 20B is shown in FIG. 21. The spacer 60 resides over the nut 34 and bolt 32 to prevent the bottom end of the solid walking stick 13 from interfering with movement of the upper portion with respect to the bolt.

Figure 22C:
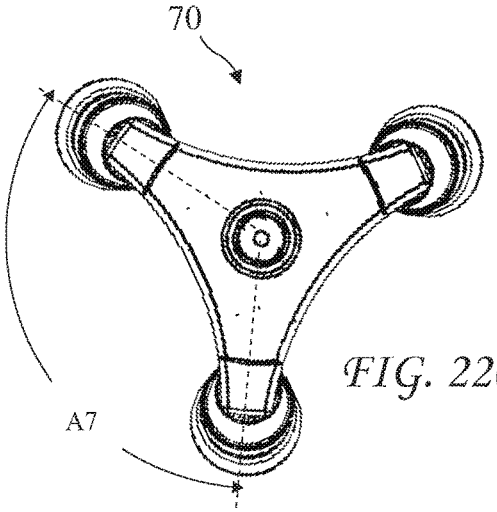
FIG. 22C shows a top view of the three point embodiment of the cushioned walking stick tip according to the present invention.
Figure 22A:
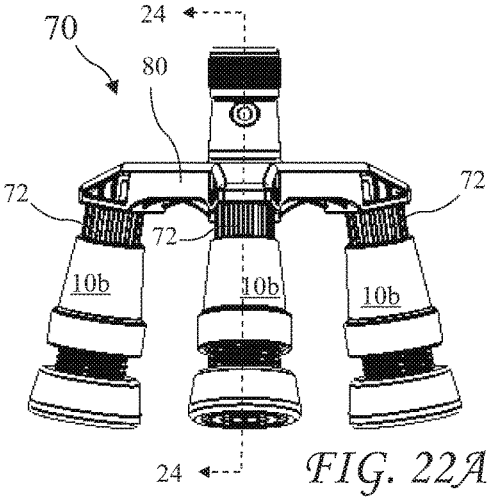
FIG. 22A shows a front view of the three point embodiment of the cushioned walking stick tip according to the present invention.
Figure 22B:
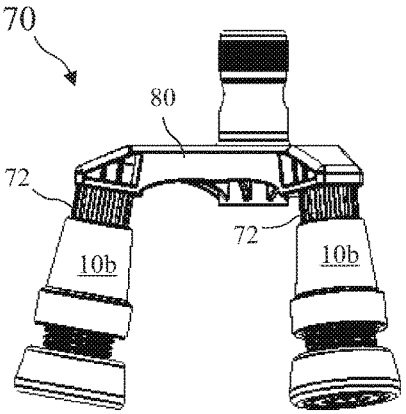
FIG. 22B shows a side view of the three point embodiment of the cushioned walking stick tip according to the present invention.
Figure 22D:
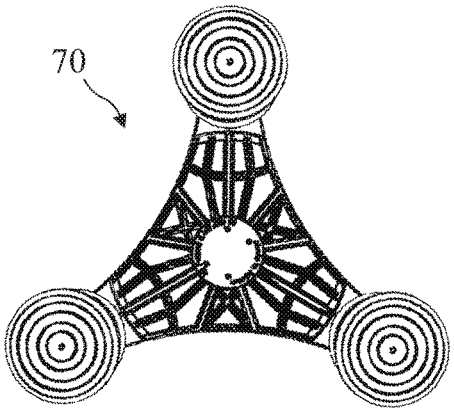
FIG. 22D shows a bottom view of the three point embodiment of the cushioned walking stick tip according to the present invention.

A front view of the three point embodiment 70 of the cushioned walking stick tip according to the present invention is shown in FIG. 22A, a side view of the three point embodiment 70 is shown in FIG. 22B, a top view of the three point embodiment 70 is shown in FIG. 22C, and a bottom view of the three point embodiment 70 is shown in FIG. 22D. The three point embodiment 70 includes a center fitting 80 connected to three of the cushioned walking stick tips 10*a* by adapters 72. The shaft 12 (see FIG. 1A, 1B) is attached to the fitting 80. The three point embodiment 70 provides additional stability when using the walking aid. The cushioned walking stick tips 10*a* are spaced apart an angle A7 of about 120 degrees and tilted out a tilt T of about 10 degrees (see FIG. 24).

Figure 24:
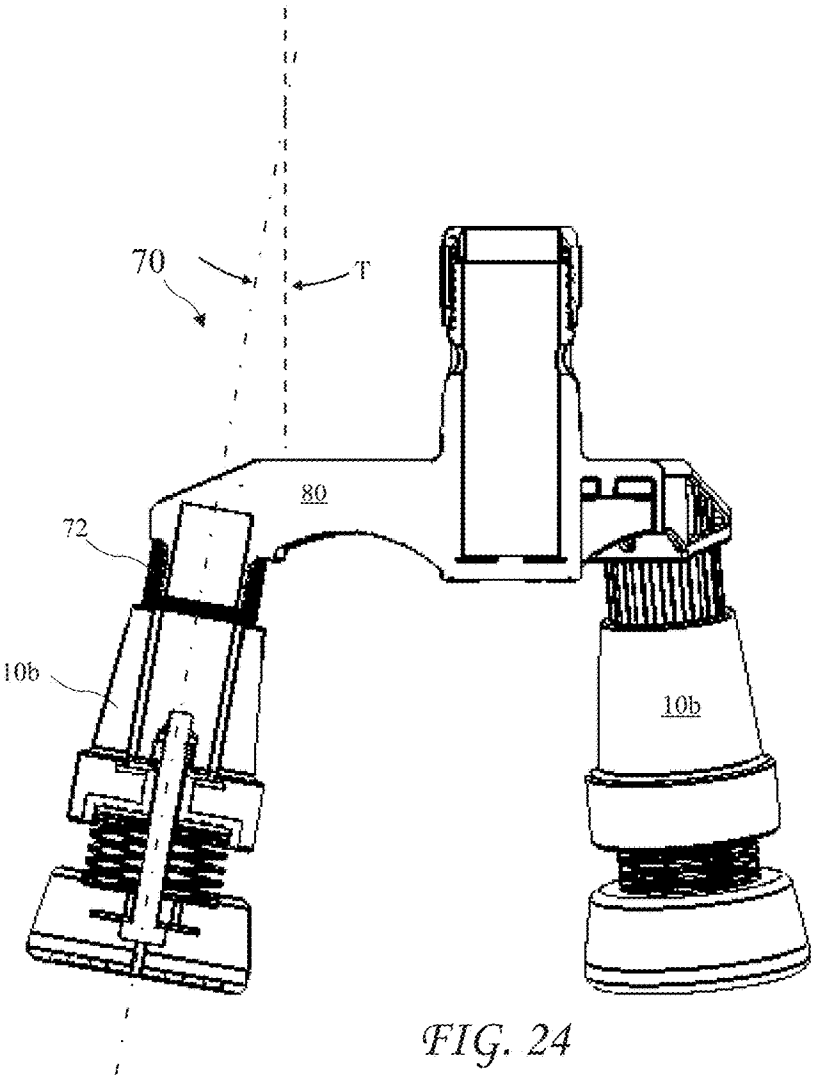
FIG. 24 shows a cross-sectional view of the three point embodiment of the cushioned walking stick tip according to the present invention taken along line 24-24 of FIG. 22A.
Figure 23:
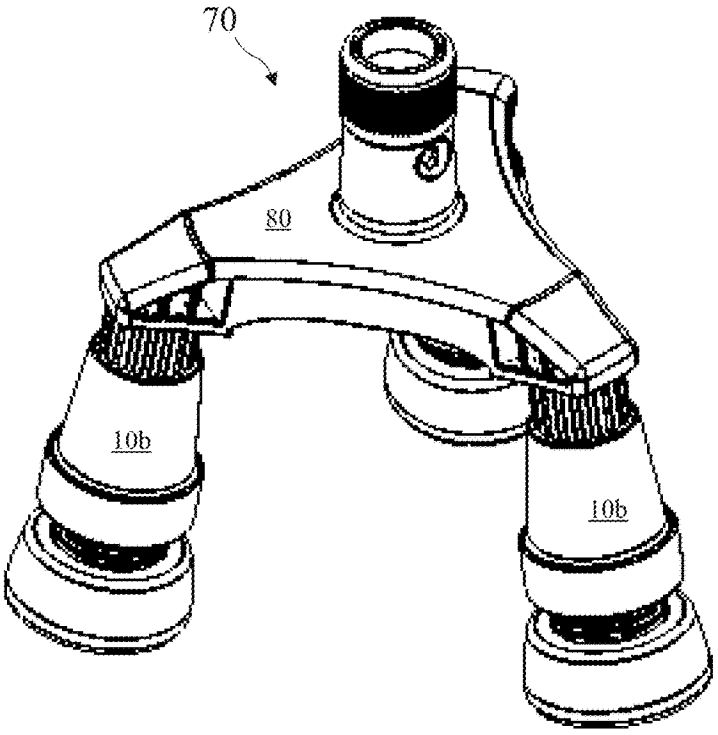
FIG. 23 shows a perspective view of the three point embodiment of the cushioned walking stick tip according to the present invention.

A perspective view of the three point embodiment 70 is shown in FIG. 23 and a cross-sectional view of the three point embodiment 70, taken along line 24-24 of FIG. 22A, is shown in FIG. 24. As seen in FIG. 24, the cushioned walking stick tips 10*a* provide impact reduction when using the three point embodiment 70.

Figure 25B:
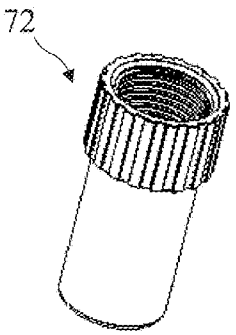
FIG. 25B shows a top/side perspective view of one of the three adapters of the three point embodiment of the cushioned walking stick tip according to the present invention.
Figure 27:
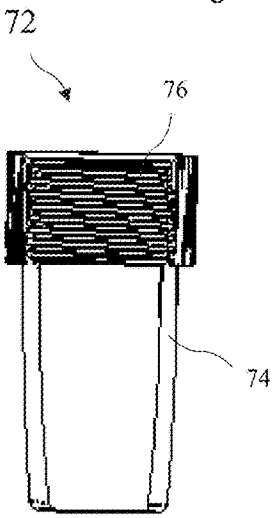
FIG. 27 shows a cross-sectional view of one of the three adapters of the three point embodiment of the cushioned walking stick tip according to the present invention taken along line 27-27 of FIG. 26.
Figure 25A:
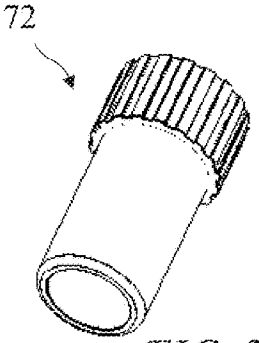
FIG. 25A shows a bottom/side perspective view of one of three adapters of the three point embodiment of the cushioned walking stick tip according to the present invention.
Figure 26:
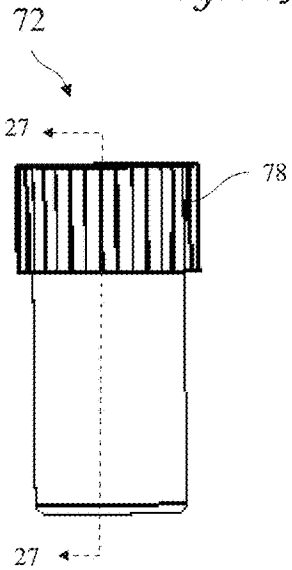
FIG. 26 shows a side view of one of the three adapters of the three point embodiment of the cushioned walking stick tip according to the present invention.

A bottom/side perspective view of one of three adapters 72 of the three point embodiment 70 is shown in FIG. 25A, a top/side perspective view of one of the three adapters 72 is shown in FIG. 25B, a side view of one of the three adapters 72 is shown in FIG. 26, and a cross-sectional view of one of the three adapters, taken along line 27-27 of FIG. 26, is shown in FIG. 27. Each of the adapters 72 includes a cylindrical portion insertable into the cushioned walking stick tips 10*a* and a threaded portion 76 for attachment to the center fitting 80. The attachment to the center fitting 80 may be threaded with either the adapters 72 having female threads and the center fitting 80 having male threads, or the adapters 72 having male threads and the center fitting 80 having female threads. Further, those skilled in the art will recognize various ways of attaching the adapter to the cushioned walking stick tips 10*a* and to the center fitting 80, and that the center fitting 80 may be directly attached to the cushioned walking stick tips 10*a* without adapters, and all of these variations are intended to come within the scope of the present invention. The adapters 72 may include a knurled surface to facilitate attachment to the center fitting 80.

Figure 28A:
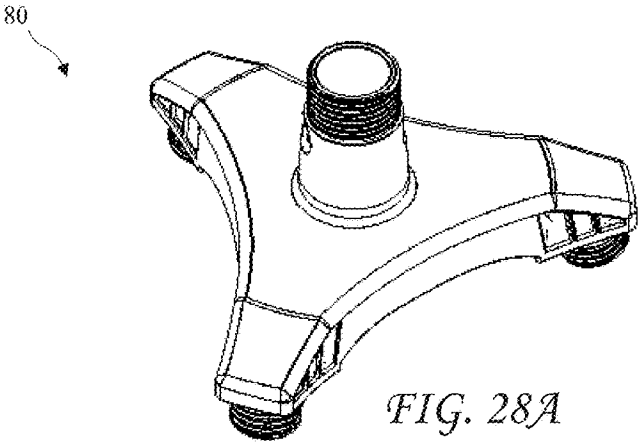
FIG. 28A shows a top perceptive view of a center fitting of the three point embodiment of the cushioned walking stick tip according to the present invention.
Figure 28B:
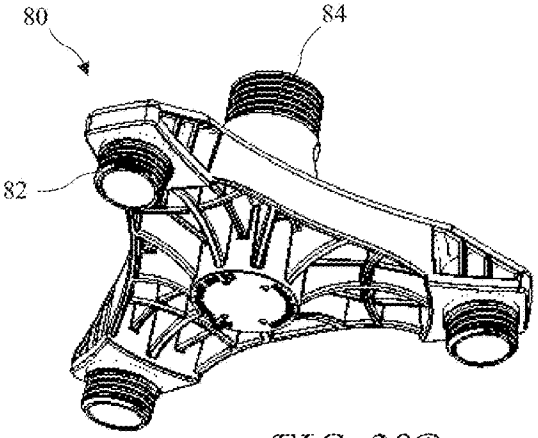
FIG. 28B shows a bottom perceptive view of a center fitting of the three point embodiment of the cushioned walking stick tip according to the present invention.

A top perceptive view of the center fitting 80 of the three point embodiment 70 is shown in FIG. 28*a* and a bottom perceptive view of a center fitting 80 is shown in FIG. 28B. The center fitting 80 includes the male threads 82 for attaching the adapters 72, and male threads 84 for attaching the shaft 12. Those skilled in the art will recognize various ways of attaching the adapter 72 to the center fitting 80 and the center fitting to the shaft 12, and that the center fitting 80 may be part of the shaft 12, and all of these variations are intended to come within the scope of the present invention.

While the invention herein disclosed has been described by means of specific embodiments and applications thereof, numerous modifications and variations could be made thereto by those skilled in the art without departing from the scope of the invention set forth in the claims.

We claim:

1. A walking stick end, comprising:

at least one cushioned walking stick tip, comprising a lower portion having a bottom surface configured to rest against a horizontal surface;

an upper portion having a shaft passage configured to attach to a user support shaft configured for grasping by a user, the user support shaft attachable to the upper portion to extend up from the upper portion;

a shock absorber residing between the lower portion and the upper portion; and a bolt connecting the lower portion to the upper portion, the upper portion tiltable a first angle A5 with respect to the bolt;

wherein the lower portion is deformable to allow the bolt to tilt a second angle A6 with respect to the lower portion, resulting in the upper portion tilting the first angle A5 plus a second angle A6 with respect to the lower portion.

2. The walking stick end of of claim 1, wherein the upper portion is rotatable with respect to the lower portion.

3. The walking stick end of of claim 2, wherein:

a cup is embedded in the upper portion, the cup includes a passages for the bolt; and a washer resides between the cup and the shock absorber, the cup and washer made from self lubrication material to facilitate the upper portion rotating with respect to the lower portion.

4. The walking stick end of of claim 1, wherein the bolt retains the shock absorber between the lower portion and the upper portion.

5. The walking stick end of of claim 4, wherein the bolt passes through the shock absorber.

6. The walking stick end of of claim 5, wherein the bolt is rigid and cooperates with a cup in the upper portion to allow the upper portion to tilt with respect to the bolt and the lower portion.

7. The walking stick end of of claim 6, wherein:

the cup is embedded into the upper portion; and the cup is restrained to reside under a nut threaded onto the bolt to retain the upper portion on the bolt.

8. The walking stick end of of claim 7, wherein the shock absorber is compressible allowing the upper portion to slide towards the lower portion when downward force is applied to the upper portion by the shaft.

9. The walking stick end of of claim 7, wherein the bolt is molded into the lower portion to resist tilting of the bolt.

10. The walking stick end of of claim 9, wherein the lower portion is deformable to allow the bolt and upper portion to tilt with respect to the lower portion.

11. The walking stick end of of claim 1, wherein the shaft is solid and is supported by a spacer residing over the bolt.

12. The walking stick end of of claim 1, wherein the at least one cushioned walking stick tip comprises three of the cushioned walking stick tips attachable to the user support shaft.

13. The walking stick end of of claim 12, wherein the three of the cushioned walking stick tips are spaced about 120 degrees apart.

14. The walking stick end of of claim 13, wherein the upper portions of the three of the cushioned walking stick tips are tilted out about 10 degrees with respect to the user walking shaft.

15. The walking stick end of of claim 12, wherein the three of the cushioned walking stick tips are attached to a center fitting using adapters, each adapter having a cylindrical portion insertable into the shaft passages of each of the cushioned walking stick tips, and the center fitting is attachable to the user support shaft.

16. The walking stick end of of claim 15, wherein the adapters engage each of the cushioned walking stick tips in the same engagement as the user support shaft may engage one of the cushioned walking stick tips.

17. The walking stick end of claim 12, further including a center fitting attachable to the user support shaft and configured for attaching the three cushioned walking stick tips angularly spaced apart and reaching down to the horizontal surface.

18. A cushioned walking stick tip, comprising:

a lower portion having a bottom surface configured to rest against a horizontal surface;

an upper portion having a shaft passage configured to receive a user support shaft;

a shock absorber residing between the lower portion and the upper portion, the shock absorber compressible allowing the upper portion to slide towards the lower portion when downward force is applied to the upper portion through the shaft; and a bolt connecting the lower portion to the upper portion and cooperating with a vertical passage portion of a cup embedded in the upper portion to allow the wherein the cup allows the upper portion rotating with respect to the lower portion, to tilt with respect to the bolt and the lower portion, and retaining the shock absorber between the lower portion and the upper portion, wherein the bolt is biased by the lower portion to remain vertical with respect to the lower portion, but is tiltable if sufficient force is applied, and the shock absorber is deformable, to allow the bolt and upper portion to tilt with respect to the lower portion.

19. A cushioned walking stick tip, comprising:

a lower portion having a bottom surface configured to rest against a horizontal surface;

an upper portion having a shaft passage configured to receive a user support shaft;

a shock absorber residing between the lower portion and the upper portion, the shock absorber compressible allowing the upper portion to slide towards the lower portion when downward force is applied to the upper portion by the shaft; and a bolt connecting the lower portion to the upper portion and cooperating with an upper pivot embedded in the upper portion to allow the upper portion to pivot with respect to the bolt and the lower portion, and passing through the shock absorber to retain the shock absorber between the lower portion and the upper portion, wherein:

the bolt is biased by the lower portion to remain vertical with respect to the lower portion, but is pivotable if sufficient force is applied, and the shock absorber is deformable, to allow the bolt and upper portion to pivot with respect to the lower portion; and the upper portion is retained to the bolt by a nut threaded on the bolt and residing inside the upper portion, the nut limiting the pivoting of the upper portion with respect to the bolt.

* * * * *